US005613837A

United States Patent [19]

Konishi et al.

[11] Patent Number: 5,613,837

[45] Date of Patent: Mar. 25, 1997

[54] AIR COMPRESSOR INLET AND OUTLET VALVE ARRANGEMENT

[75] Inventors: Yoshichika Konishi, Nagoya; Hiroshi Kubo, Chiryu, both of Japan

[73] Assignee: Aisin Seiki Kabushiki Kaisha, Kariya, Japan

[21] Appl. No.: 674,574

[22] Filed: Jul. 1, 1996

Related U.S. Application Data

[63] Continuation of Ser. No. 429,154, Apr. 26, 1995, abandoned.

[30] Foreign Application Priority Data

Apr. 27, 1994 [JP] Japan ..... 6-090159

[51] Int. Cl.[6] ..... F04B 39/10

[52] U.S. Cl. ..... 417/255; 417/259; 417/550; 417/562

[58] Field of Search ..... 417/259, 545, 417/550, 255, 562

[56] References Cited

U.S. PATENT DOCUMENTS

| | | | |
|---|---|---|---|
| 898,659 | 9/1908 | Kuehl | 417/569 |
| 936,609 | 10/1909 | Dailey | 417/255 |
| 1,109,154 | 9/1914 | Thomas | 417/255 |
| 1,746,394 | 2/1930 | Guild | 417/255 |
| 3,004,810 | 10/1961 | King | 417/550 |
| 4,289,159 | 9/1981 | Ehemann et al. . | |
| 4,532,685 | 8/1985 | Itoh et al. | 417/562 |
| 4,820,133 | 4/1989 | Steele et al. . | |
| 4,995,795 | 2/1991 | Hetzel et al. | 417/571 |
| 5,022,832 | 6/1991 | Lauterbach et al. . | |

FOREIGN PATENT DOCUMENTS

| | | | |
|---|---|---|---|
| 184867 | 12/1906 | Germany | 417/550 |
| 16906 | 2/1978 | Japan | 417/550 |
| 55-69369 | 5/1980 | Japan . | |
| 1-190973 | 8/1989 | Japan . | |
| 2-277978 | 11/1990 | Japan . | |

OTHER PUBLICATIONS

"Reading–Book of Air–Pressure for Engineering Development" published by Kaihatsu–sha on Mar. 10, 1971.

*Primary Examiner*—Timothy Thorpe
*Assistant Examiner*—Roland G. McAndrews, Jr.
*Attorney, Agent, or Firm*—Burns, Doane, Swecker & Mathis, LLP

[57] ABSTRACT

An air compressor includes a suction space, a compression space and a discharge space that are aligned with one another. The compressor also includes one-way valves that function as a suction valve and a discharging valve. The open areas of the suction valve and the discharge valve are sufficiently enlarged since both valves are not formed in the same element. Therefore, both valves can permit a large amount of air flow. Further, the suction space serves as a crank space so that fresh air is always drawn into the crank space to cool the crank space.

9 Claims, 6 Drawing Sheets

AIR COMPRESSOR INLET AND OUTLET VALVE ARRANGEMENT

This application is a continuation of application Ser. No. 08/429,154, filed Apr. 26, 1995, now abandoned.

FIELD OF THE INVENTION

The present invention relates to an air compressor. More particularly, the present invention concerns an air compressor for supplying high pressure air to a desired device such as, for example, a fuel injector.

BACKGROUND OF THE INVENTION

A conventional air compressor, as shown in FIG. 6, is disclosed in a publication entitled "Reading-Book of Air-Pressure for Engineering Development" published by KAIHATSU-sha on Mar. 10, 1971. Referring to FIG. 6, the air compressor described in that publication comprises a housing 100 having a cylinder 101, a piston 102 movably located in the cylinder 101, an intake valve 103 functioning as a one-way valve, and an exhaust valve 106 functioning as a one-way valve. The intake valve 103 opens during a suction process of the air compressor and permits air flow from the atmosphere into a compression space 104 formed in the cylinder 101 through a filter 105. The exhaust valve 106 opens during a discharge process of the air compressor and permits air flow from the compression space 104 through a pipe 111 to an apparatus which uses the air pressure. Both of the intake valve 103 and the exhaust valve 106 are located in a cylinder head 114.

The piston 102 is connected to a crank shaft 108 by way of a connecting rod 107. The crank shaft 108 is located in a crank space 109 and is connected to a drive source (not shown). The connecting rod 107 transforms revolutionary movement of the crank shaft 108 into axial movement of the piston 102. That is, the piston 102 moves upwardly and downwardly in the cylinder 101. Such movement of the piston 102 periodically increases and decreases the volume in the compression space 104, and air sucked through the filter 105 and the intake valve 103 is compressed and discharged through the exhaust valve 106 by way of the pipe 111.

The open area of the intake valve 103 and the exhaust valve 106 cannot be enlarged since each valve 103, 106 is located on one side of the piston 102 in the cylinder head 114. Therefore, each open area of the intake valve 103 and the exhaust valve 106 must be small and the small open areas of the valves 103, 106 resists air flow through the valves 103, 106. As a result of the resistance to air flow, the discharged air flow of the air compressor becomes low during low revolutionary speed and high revolutionary speed as shown by line C in FIG. 5.

Further, not only the volume in the compression space 104 but also the volume in the crank space 109 is increased and decreased according to the movement of the piston 102 so that the temperature in the crank space 109 rises. A cooling fan 110 is thus required for cooling the crank space 109.

SUMMARY OF THE INVENTION

It would be desirable, therefore, to provide an air compressor having an enlarged open area of the intake valve and the exhaust valve.

It would also be desirable to provide an air compressor in which the crank space is prevented from experiencing significant increases in temperature.

In light of the foregoing, the compressor according to the present invention comprises a housing that includes a cylinder having an interior and a cover that covers an upper end of the cylinder, and a piston positioned in the interior of the cylinder for movement in a first direction and a second direction opposite the first direction, the piston dividing the interior of the cylinder into a first space positioned on one side of the piston and a second space positioned on an opposite side of the piston. A crank shaft is connected to the piston and is connectable to a drive source to move the piston in the first and second directions. At least one hole extends through the piston to provide communication between the first space and the second space and a valve is operatively associated with the at least one hole for closing the at least one hole to prevent communication between the first space and the second space during movement of the piston in the first direction and for opening the at least one hole to permit communication between the first space and the second space during movement of the piston in the second direction.

In accordance with another aspect of the invention, the compressor includes a housing having a cylinder and a cover closing an open upper end of the cylinder, a piston slidably located in the cylinder for movement in first and second opposite directions, and a drive source connected to the piston for moving the piston. A pre-compression space is formed in the cylinder into which fluid is drawn during movement of the piston in the first direction and in which fluid is compressed during movement of the piston in the second direction. A compression space is also provided in the cylinder in which fluid is compressed during movement of the piston in the first direction. The compression space is separated from the pre-compression space by the piston. The compressor also includes a first one-way valve for permitting fluid flow from outside the housing to the pre-compression space during movement of the piston in the first direction, a second one-way valve for permitting fluid flow from the pre-compression space to the compression space during movement of the piston in the second direction, and a third one-way valve located on the cover for discharging fluid from the compression space .when the pressure in the compression space becomes higher than a predetermined amount.

According to another aspect of the invention, an air compressor comprises a housing that includes a cylinder and a cover closing an upper end of the cylinder, a piston slidably located in the cylinder for movement in first and second opposite directions, a drive source connected to the piston for driving the piston, and three spaces formed in the housing and aligned with one another to define two end spaces and an intermediate space so that fluid located in one of the end spaces flows through the intermediate space and into the other end space during movement of the piston in the first direction and the second direction.

BRIEF DESCRIPTION OF THE DRAWING FIGURES

A more complete appreciation of the invention and many of the attendant advantages thereof will be more readily appreciated and understood with reference to the following detailed description considered in connection with the accompanying drawing figures in which like elements bear like reference numerals and wherein.

DETAILED DESCRIPTION OF THE PREFERRED EMBODIMENTS

Figure 1:
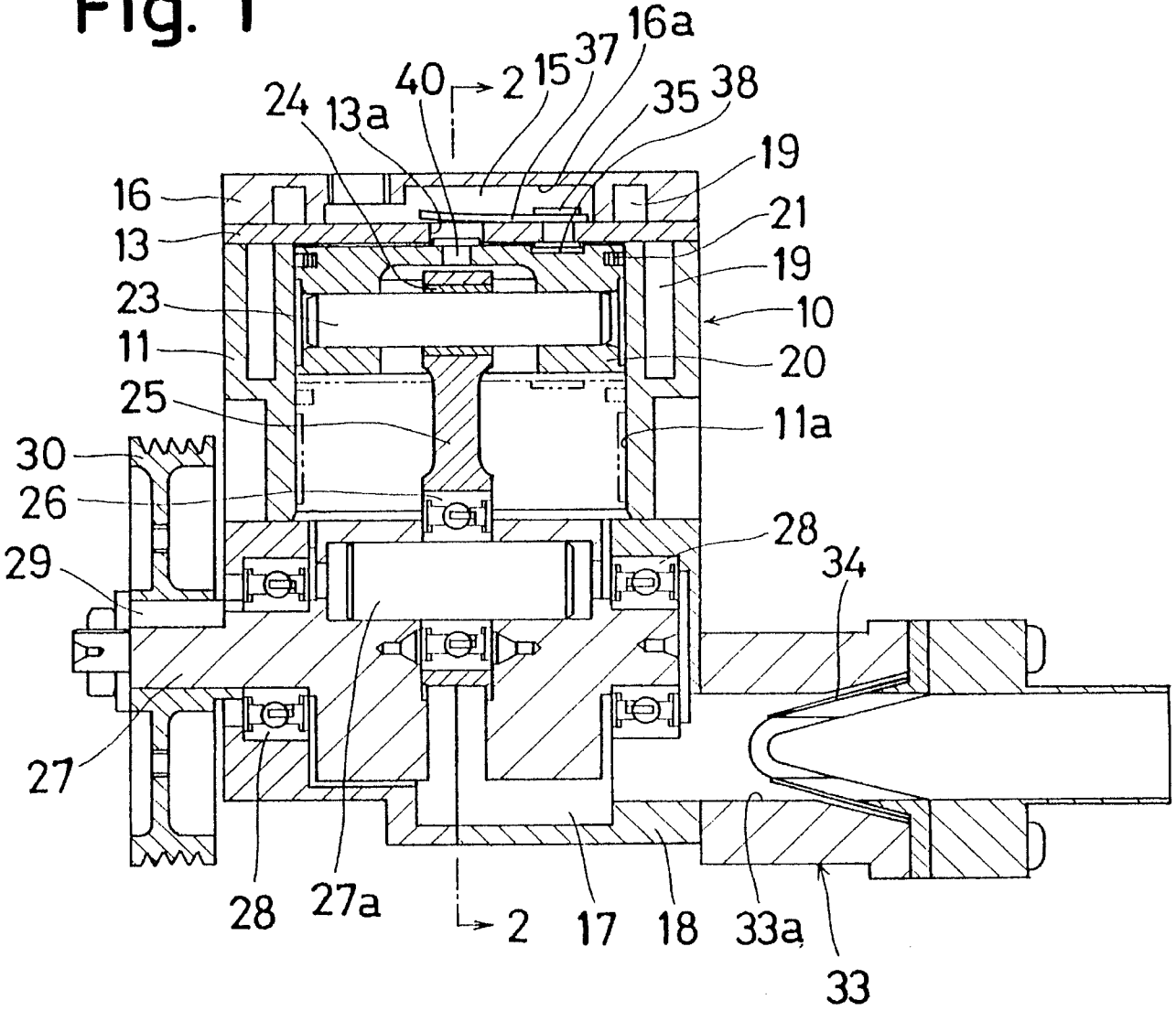
FIG. 1 is a cross-sectional view of an air compressor according to an embodiment of the present invention.

Referring first to FIG. 1, the compressor according to the present invention includes a housing 10 comprised of a cylinder 11, a cover 13, a cylinder head 16 and a container 18. The cover 13 is positioned on the cylinder 11 to close the open upper end of the cylinder 11. A piston 20 divides the interior of the housing 10 into a first space 22 (FIG. 3) which functions as a compression space and a second space 17 which functions as a pre-compression space, a crank space, or a suction space.

A piston ring 21 is located around the outer periphery of the piston 20 to provide a seal with respect to the inner surface of the cylinder 11. The upper end of a connecting rod 25 is connected to the piston 20 via a pin 23 and a bearing 24. The lower end of the connecting rod 25 is connected to an eccentric portion 27*a* of a crank shaft 27 via a bearing 26. The connecting rod 25 transfers or transforms revolutionary movement of the crank shaft 27 into axial movement of the piston 20. That is, the piston 20 moves upwardly and downwardly in the cylinder 11. The crank shaft 27 is rotatably supported on the container 18 via a bearing 28, and a pulley 30 is fixed to the left end of the shaft 27 via a pin 29. The crank shaft 17 is driven by a drive source 40 by way of the pulley 30.

Figure 2:
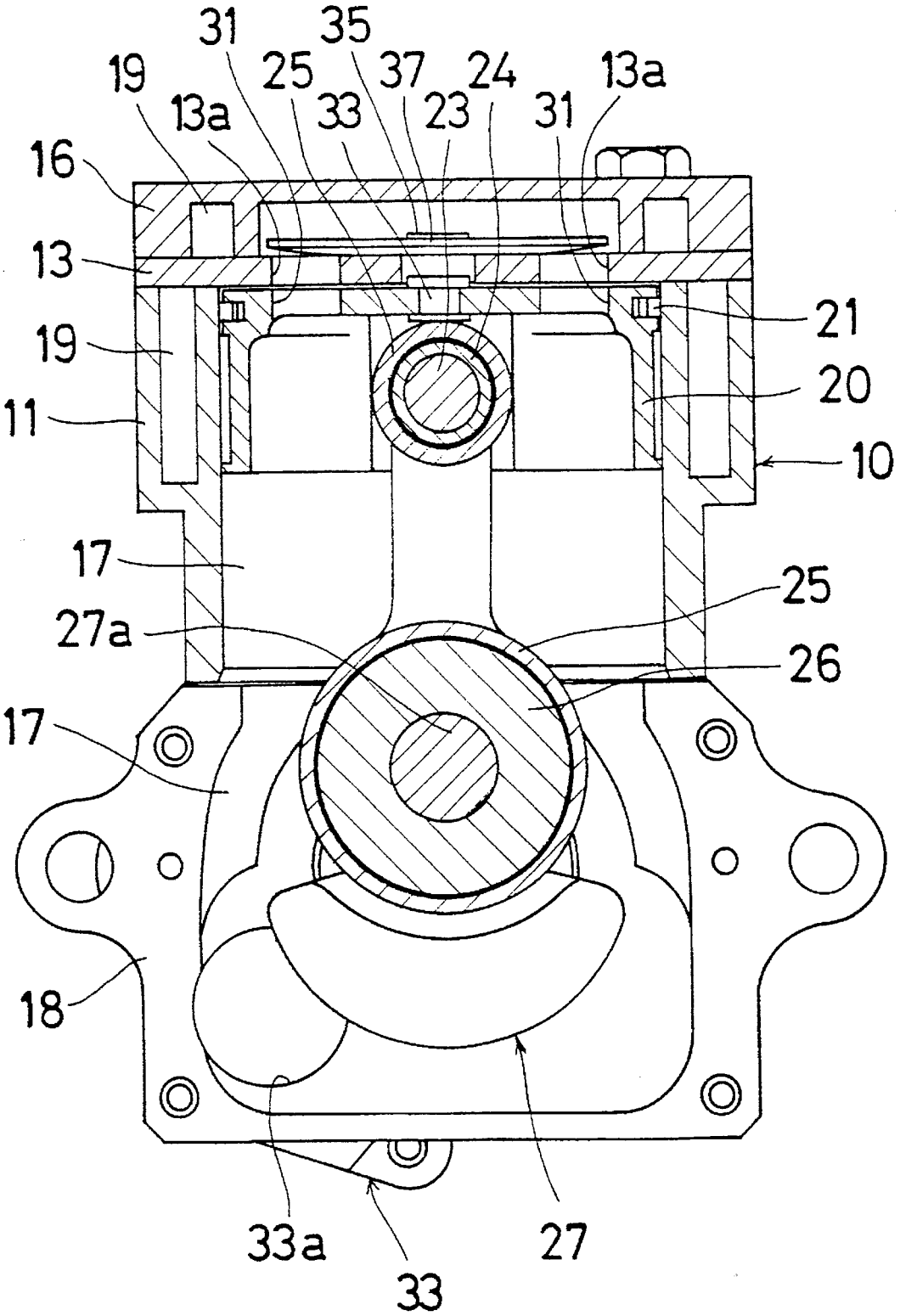
FIG. 2 is a cross-sectional view along the section line 2—2 of FIG. 1 with a body and a cover.
Figure 3:
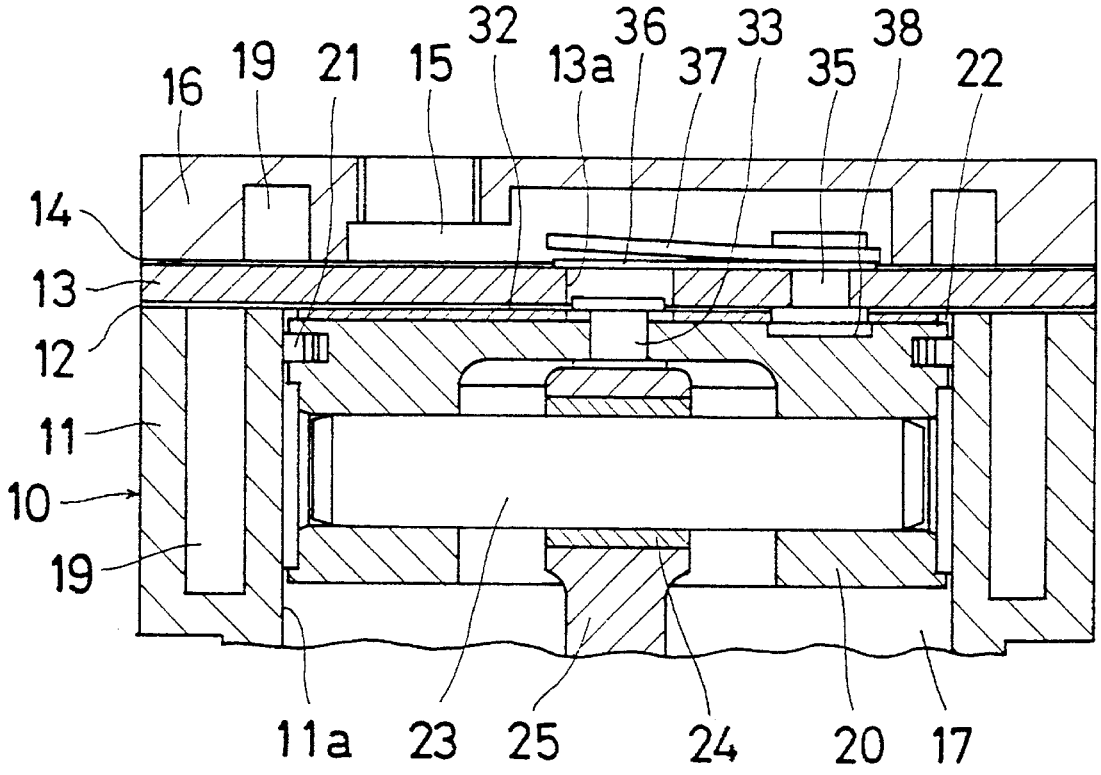
FIG. 3 is an enlarged sectional view of a portion of the air compressor shown in FIG. 1 including a piston, a cylinder, a cover and a cylinder head of FIG. 1.

As seen with reference to FIG. 2, the suction space or pre-compression space 17 is in fluid communication with the compression space 22 via through holes 31 formed in the piston 20. FIG. 3 illustrates a first flexible valve plate 32 which functions as a one-way valve and a suction valve. The valve plate 32 bends to open and close the through holes 31.

Figure 4:
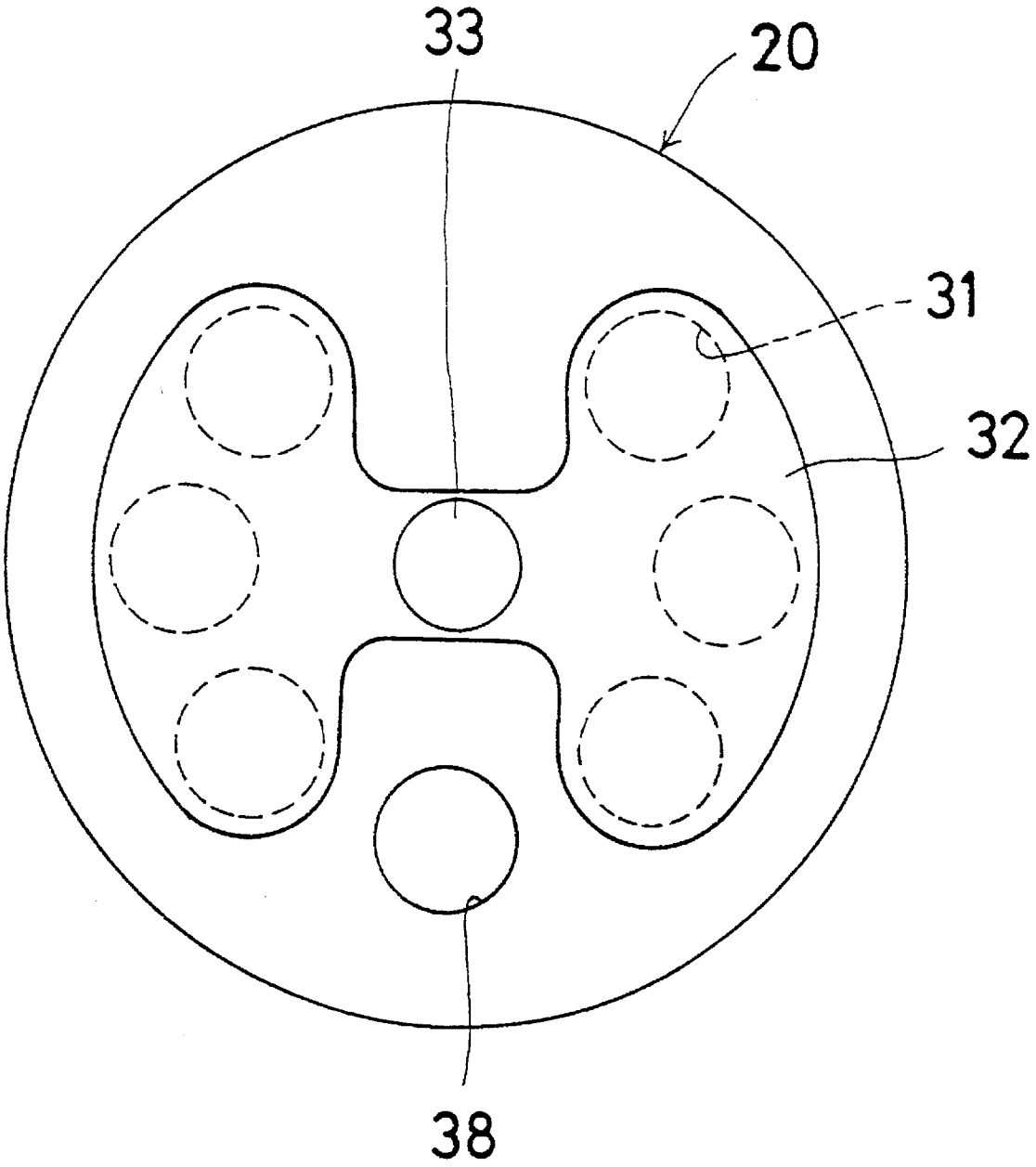
FIG. 4 is a top view of the piston according to the embodiment of the invention shown in FIG. 1.

FIG. 4 illustrates the flexible valve plate 32 in more detail. The center of the valve plate 32 is fixed to the top of the piston 20 by a rivet 40. A depression 38 formed on the top of the piston 20 receives the lower projection of a rivet 35 when the piston 20 is in the top dead center (TDC) position.

The suction space or pre-compression space 17 is also in fluid communication with a suction passage 33*a* of a port 33. The port 33 can be formed in one piece with the housing 11 or can be formed separate from the housing 11 and connected thereto. A one-way valve (first valve) 34 is located in the passage 33*a* and permits fluid flow from outside the suction space 17 (i.e., from the atmosphere) into the suction space 17 through the passage 33*a*.

The cover 13 closes the open upper end of the cylinder and separates the compression space 22 from a discharge space 15 functioning as a first space. The discharge space 15 is disposed above the compression space 22 and a recess 16*a* is formed in the cylinder head 16 to define the discharge space 15. Thus, the compression space 22 is disposed between the discharge space 15 and the pre-compression space 17. The three spaces 22, 15, 17 are also aligned with one another. Three outlets or holes 13*a* are formed in the cover 13 as shown in FIG. 2. The outlets or holes 13*a* positioned on either side of the central hole are aligned with corresponding ones of the through holes 31 in the piston 20. The outlets 13*a* provide fluid communication between the compression space 22 and the discharge space 15 formed in the cylinder head 16.

A second flexible valve plate 36, which functions as a one-way valve and as a discharge valve, bends to open and close the outlets 13*a* as depicted in FIG. 2. One end of the valve plate 36 is fixed to a top of the cover 13 by a rivet 35. A protector 37 is also fixed to the top of the cover 13 to prevent the valve plate 36 from over-bending.

The operation of the compressor will be described below. Generally speaking, the drive source drives the crank shaft 17 so that the piston 20 moves upwardly and downwardly within the interior of the cylinder 11. The movement of the piston 20 within the inferior of the cylinder 11 effects a pre-compression process, suction process, compression process and discharge process.

PRE-COMPRESSION PROCESS

The through holes 31 in the piston 20 are closed and the outlets 13*a* in the cover 13 are opened at the top dead center (TDC) position of the piston 20. During the downward movement of the piston 20 from the TDC position to a bottom dead center (BDC) position, the volume of the compression space 22 expands. Thus, the pressure in the compression space 22 becomes low or is reduced. The second valve plate 36 located on the cover 13 closes the outlets 13*a* upon movement of the piston 20 from the TDC position since the valve plate 36 is bent corresponding to a pressure differential between the compression space 22 and the discharge space 15. In other words, the pressure in the compression space 22 is lower than that in the discharge space 15 after the piston 20 moves away from the TDC position, so that the outlets 13*a* are closed by the second valve plate 36.

The first flexible valve plate 32 is bent corresponding to a pressure differential between the compression space 22 and the suction space 17. Further, the inertia force acting on the valve plate 32 lets the valve plate 32 open when the piston 20 moves downwardly. During downward movement of the piston 20, the volume of the suction space 17 is being reduced and the pressure in the suction space 17 is increasing. Therefore, the first valve plate 32 is spaced apart from the piston 20 to open the through holes 31 when the pressure in the suction space 17 becomes larger than that in the compression space 22 (a time C1). Fluid in the suction space 17 is pre-compressed between the time when the piston 20 is at the TDC position and the time C1.

SUCTION PROCESS

After the piston 20 moves downwardly continually from the time C1, the through holes 31 have already opened so that fluid in the suction space 17 flows into the compression space 22. This fluid flow ends when the piston 20 reaches the BDC position.

COMPRESSION PROCESS

As the piston 20 moves upwardly from the BDC position to the TDC position, the volume of the compression space 22 becomes smaller. Thus, the pressure in the compression space 22 increases. The first valve plate 32 located on the piston 20 closes the through holes 31 upon movement of the piston 20 from the BDC position because of another inertia force and the pressure differential between the compression space 22 and the suction space 17. In other words, the pressure in the compression space 22 is higher than that in the suction space 17 after the piston 20 leaves the BDC position, so the through holes 31 are closed by the first valve plate 32. In accordance with the upward movement of the piston 20, the pressure in the compression space 22 increases more and more since both the through holes 31 and the outlets 13*a* are closed. Also, fluid is drawn into the suction space 17 by way of the valve 34 and the passage 33*a*.

DISCHARGE PROCESS

When the pressure in the compression space 22 exceeds or is higher than that in the discharge space 15, the second valve plate 36 is spaced apart from or moves away from the cover 13 to open the outlets 13*a* (time C2). Fluid compressed in the compression space 22 flows into the discharge space 15 by way of the outlets 13*a*. This fluid flow into the discharge space 15 ends at the TDC position of the piston 20.

The open areas of the through holes 31 and the outlets 13*a* are sufficiently enlarged since the through holes 31 are formed in the piston 20 and the outlets 13*a* are formed in the cover 15. That is, both the through holes 31 and the outlets 13*a* are not formed in the same member. Therefore, both the through holes 31 and the outlets 13*a* are able to permit the flow of a large amount of fluid. This is useful for increasing the discharge capacity of the air compressor driven under the high revolutionary speed, as shown with reference to the line A in FIG. 5.

Figure 5:
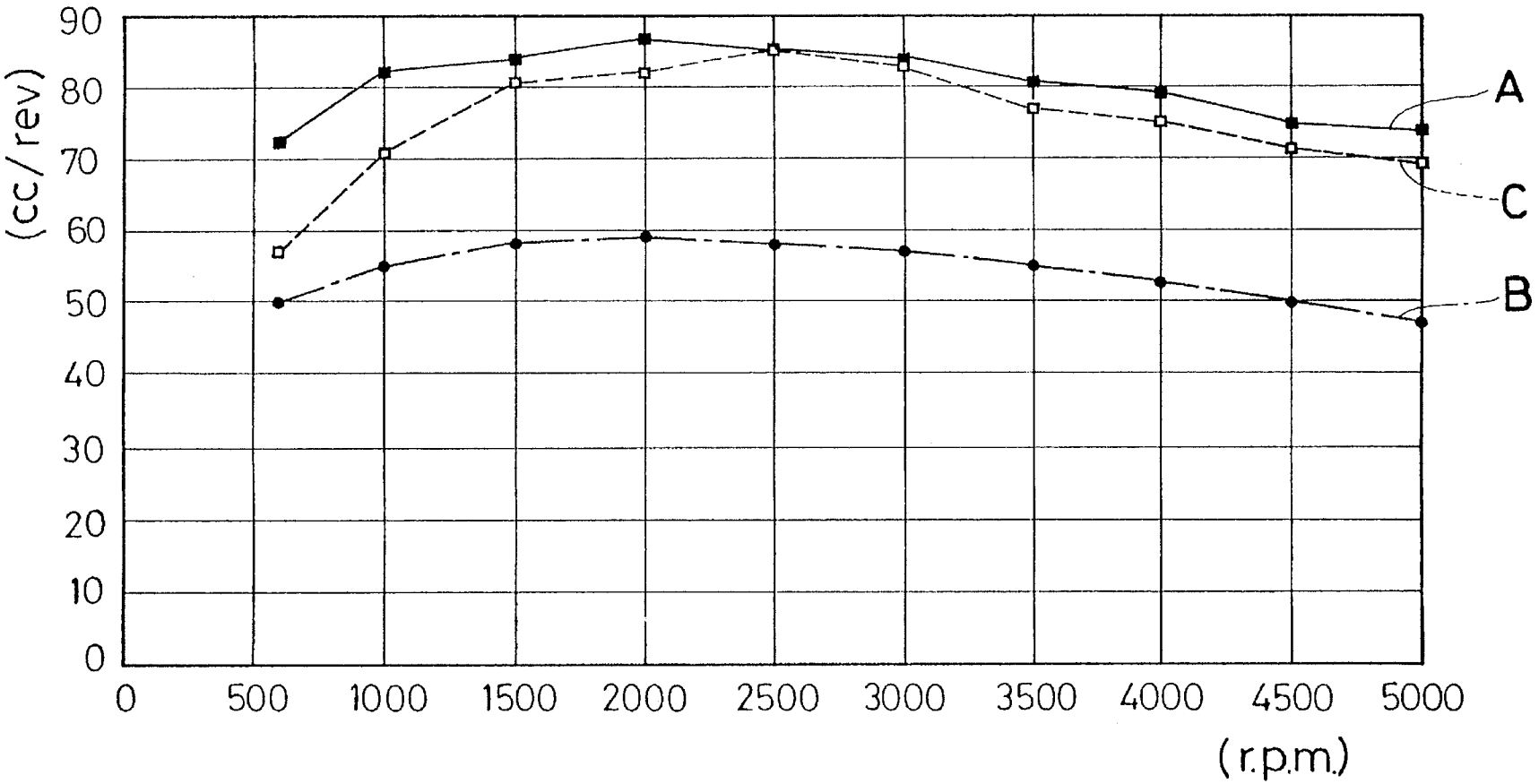
FIG. 5 is a comparative graph showing characteristics of discharged air flow of the air compressors of the present invention and a conventional device.
Figure 6:
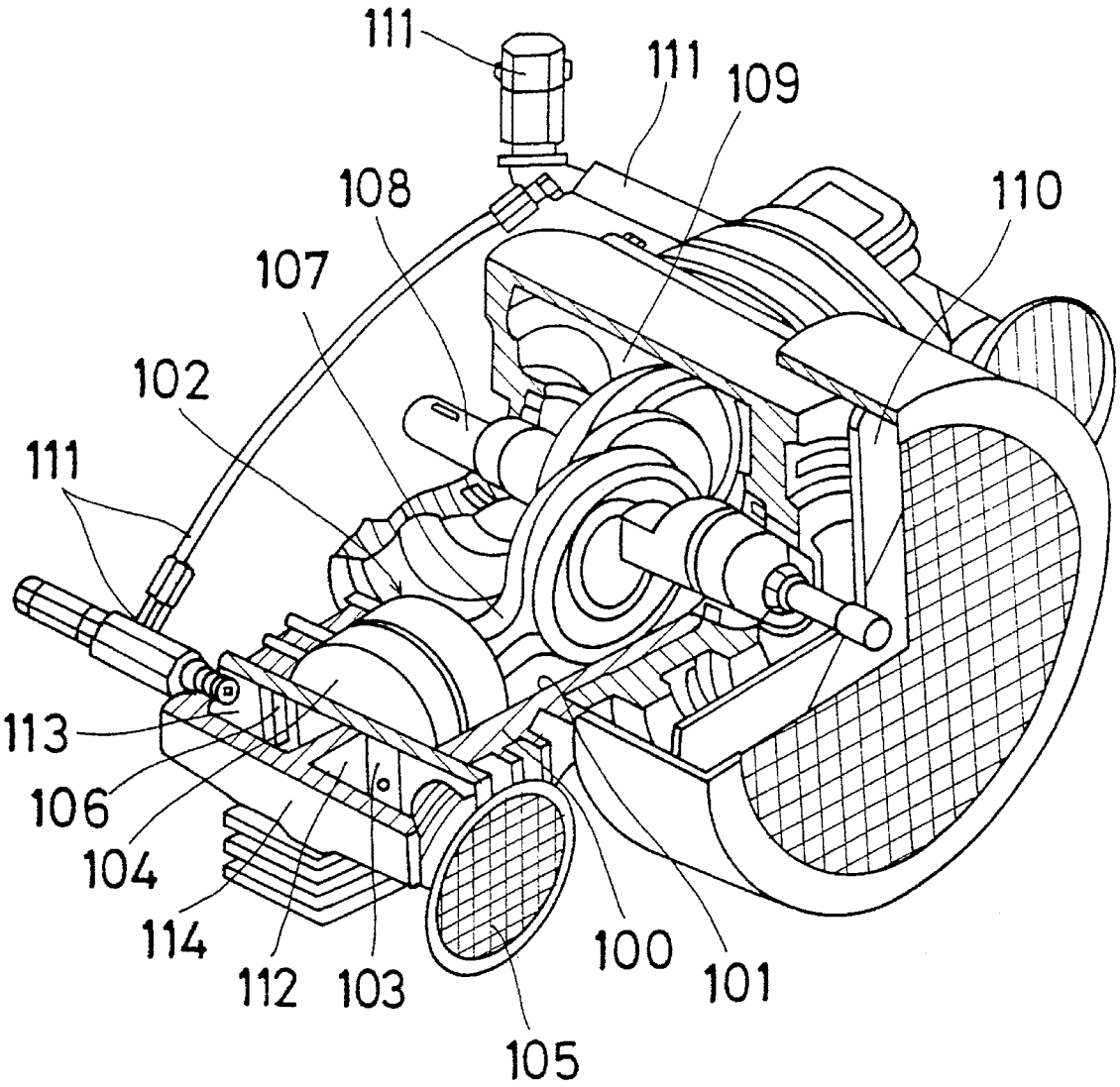
Fig. 6 (Prior Art)
FIG. 6 is a perspective view of a conventional air compressor.

In FIG. 5, the vertical line shows the amount of fluid discharged per revolution of the crank shaft 27 (cc/rev) and the horizontal line shows the number of revolutions of the crank shaft 27 per minute (rpm). The suction space 17, the compression space 22 and the discharge space 15 are aligned so that the fluid flow direction is one way along a generally straight path and is not circuitous or winding. This is useful for increasing the discharge capacity of the air compressor driven under all revolutionary speeds, as shown by the line A in FIG. 5.

The suction space serves as the crank space so that fresh fluid is always drawn into the crank space through the passage 33*a* to cool the crank space. Further, the fluid in the suction space is compressed and supplied into the compression space. That is, the air compressor has a double compressing portion so that the amount of fluid discharged from the air compressor per revolution of the crank shaft 27 is larger than that of the air compressor having one compressing space per revolution of the crank shaft 27. The discharge capacity of the air compressor having one compressing space is shown by the line B in FIG. 5.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A compressor comprising:

a housing that includes a cylinder having an open upper end, and a cover closing the open upper end of the cylinder, the cover being provided with a recessed portion;

a piston slidably located in the cylinder for movement in first and second opposite directions, said piston being movable between a bottom dead center position and a top dead center position, said piston being provided with a recessed portion;

a drive source connected to the piston for moving the piston;

a pre-compression space formed in the cylinder into which fluid is drawn during movement of the piston in the first direction and in which fluid is compressed during movement of the piston in the second direction;

a compression space formed in the cylinder and in which fluid is compressed during movement of the piston in the first direction, the compression space being separated from the pre-compression space by the piston;

a first one-way valve for permitting fluid flow from outside the housing to the pre-compression space during movement of the piston in the first direction;

a second one-way valve for permitting fluid flow from the pre-compression space to the compression space during movement of the piston in the second direction, said second one-way valve including a flexible valve plate having a portion fixed to said piston by a first fixing member, a portion of said first fixing member being received in the recessed portion in the cover when the piston is in the top dead center position; and a third one-way valve for discharging fluid from the compression space when the pressure in the compression space becomes higher than a predetermined amount, said third one-way valve being a flexible valve plate having a portion fixed to said cover by a second fixing member, a portion of said second fixing member being received in the recessed portion in the piston when the piston is in the top dead center position.

2. A compressor of claim 1, wherein the cover comprises at least one through hole which is opened and closed by the third one-way valve.

3. A compressor of claim 1, wherein the piston comprises at least one through hole extending between the compression space and the pre-compression space, said at least one through hole being opened and closed by the second one-way valve.

4. A compressor of claim 3, wherein the cover comprises at least one through hole which is opened and closed by the third one-way valve, the at least one through hole in the cover being opposed to the at least one through hole in the piston.

5. A compressor comprising:

a housing that includes a cylinder having an interior and an open upper end, and a cover that covers the upper end of the cylinder to close the open upper end of the cylinder, the cover being provided with a recessed portion;

a piston positioned in the interior of the cylinder for movement in a first direction and a second direction opposite the first direction, the piston being movable between a bottom dead center position and a top dead center position and being provided with a recessed portion, the piston dividing the interior of the cylinder into a first space positioned on one side of the piston and a second space positioned on an opposite side of the piston, said first space being located on one side of the cover, and including a third space located on an opposite side of the cover;

a crank shaft connected to the piston and connectable to a drive source to move the piston in the first and second directions;

at least one first hole extending through the piston to provide communication between the first space and the second space; and at least one second hole extending through the cover to provide communication between the first space and the third space;

a valve operatively associated with the at least one first hole for closing the at least one first hole to prevent communication between the first space and the second space during movement of the piston in the first direction and for opening the at least one first hole to permit communication between the first space and the second space during movement of the piston in the second direction, said valve which is operatively associated with the at least one first hole including a flexible valve plate having one portion secured to the piston by a first fixing member, a portion of said first fixing member being received in the recessed portion in the cover when the piston is in the top dead center position; and a valve operatively associated with the at least one second hole for closing the at least one second hole to prevent communication between the first space and the third space during movement of the piston in the second direction and for opening the at least second hole to permit communication between the first space and the third space during movement of the piston in the first direction, said valve which is operatively associated with the at least one second hole including a flexible valve plate having a portion fixed to the cover by a second fixing member, a portion of said second fixing member being received in the recessed portion in the piston when the piston is in the top dead center position.

6. A compressor of claim 5, wherein the second space communicates with a passage in a port, and including a one-way valve positioned in the passage for being opened during movement of the piston in the first direction and for being closed during movement of the piston in the second direction.

7. Air compressor comprising:

a housing that includes a cylinder having an upper end, and a cover closing the upper end of the cylinder, said cover being provided with at least one through hole and a recessed portion;

a piston slidably located in the cylinder for movement in first and second opposite directions, said piston being movable between a top dead center position and a bottom dead center position, said piston being provided with at least one through hole and a recessed portion;

a drive source connected to the piston for driving the piston;

three spaces formed in the housing and aligned with one another to define two end spaces and an intermediate space so that fluid located in one of the end spaces flows through the intermediate space and into the other end space during movement of the piston in the first direction and the second direction, said at least one through hole in the cover permitting communication between the intermediate space and said other end space and said at least one through hole in the piston permitting communication between the intermediate space and said one end space;

a one-way valve operatively associated with the at least one hole in the cover to permit fluid flow from the intermediate space to said other end space while preventing fluid flow from said other end space to the intermediate space, said one-way valve which is operatively associated with the at least one hole in the cover including a flexible valve plate having a portion secured to the cover by a first fixing member, a portion of said first fixing member being received in the recessed portion in the piston when the piston is in the top dead center position; and a one-way valve operatively associated with the at least one hole in the piston to permit fluid flow from said one end space to the intermediate space while preventing fluid flow from the intermediate space to said one end space, said one-way valve which is operatively associated with the at least one hole in the piston including a flexible valve plate having a portion secured to the piston by a second fixing member, a portion of said second fixing member being received in the recessed portion of the cover when the piston is in the top dead center position.

8. A compressor of claim 7, wherein the one end space is a space into which fluid is drawn during movement of the piston in the first direction and in which fluid is compressed during movement of the piston in the second direction, the other end space is a space into which fluid is discharged during movement of the piston in the first direction, and the intermediate space is a space in which fluid is compressed during movement of the piston in the first direction, said one end space being separated from the intermediate space by the piston.

9. A compressor of claim 8, wherein the at least one through hole in the cover is opposed to the at least one through hole in the piston.

* * * * *